US007229575B2

(12) United States Patent
Wang et al.

(10) Patent No.: US 7,229,575 B2
(45) Date of Patent: Jun. 12, 2007

(54) OVER-CURRENT PROTECTION DEVICE AND CONDUCTIVE POLYMER COMPOSITION THEREOF

(75) Inventors: David Shau-Chew Wang, Taipei (TW); En-Tien Yang, Taipei (TW)

(73) Assignee: Polytronics Technology Corporation, Hsinchu (TW)

( * ) Notice: Subject to any disclaimer, the term of this patent is extended or adjusted under 35 U.S.C. 154(b) by 448 days.

(21) Appl. No.: 10/845,400

(22) Filed: May 13, 2004

(65) Prior Publication Data

US 2005/0063122 A1 Mar. 24, 2005

(30) Foreign Application Priority Data

Sep. 24, 2003 (TW) ..... 92126391 A

(51) Int. Cl.
*H01B 1/24* (2006.01)

(52) U.S. Cl. ..... 252/511; 526/206; 338/22 R

(58) Field of Classification Search ..... 252/511; 526/206; 338/22 R
See application file for complete search history.

(56) References Cited

U.S. PATENT DOCUMENTS 4,367,168 A * 1/1983 Kelly ..... 252/511
4,668,857 A * 5/1987 Smuckler ..... 219/549
4,859,836 A * 8/1989 Lunk et al. ..... 219/548
6,533,955 B1 * 3/2003 Molnar et al. ..... 252/511

* cited by examiner

*Primary Examiner*—Mark Kopec
(74) *Attorney, Agent, or Firm*—Seyfarth Shaw LLP

(57) ABSTRACT

The conductive polymer composition used in an over-current protection device blends a polymer substrate (for instance, PVDF) with the polyolefin and the conductive filler of carbon black alike. The polyolefin comprises of two monomers along the carbon chain to form its principal chemical structure. The first monomer includes four hydrogen atoms to bond with the carbon chain, and the second monomer includes at least one fluorine atom and at least one non-fluorine halogen atom. The non-fluorine halogen atom may be selected from chlorine, bromine and iodine elements.

11 Claims, 3 Drawing Sheets

OVER-CURRENT PROTECTION DEVICE AND CONDUCTIVE POLYMER COMPOSITION THEREOF

BACKGROUND OF THE INVENTION (A) Field of the Invention

The present invention is related to an over-current protection device and conductive polymer composition thereof, more particularly, to a positive temperature coefficient property of over-current protection device and conductive polymer composition thereof.

(B) Description of Related Art

The electrical resistance of conductive composition with the so-called Positive Temperature Coefficient (PTC) property is sensitive to the variation of temperature. Consequently, it is popularly used as a current-sensing device in over-current protection devices to protect battery and circuitry devices. Since the conductive PTC composition keeps a very low value of resistance at normal temperature, it will allow the circuitry and battery to work normally. Reversely, if the circuitry and battery meet over-current or over-temperature, its resistance will abruptly raise to a high value (at least above $10^4$ ohm), and meanwhile, the over-current is reversely cancelled in order to obtain the goal of protecting the battery or circuitry.

In general, the conductive PTC composition is comprised of one or more crystallized polymers and the conductive filler. This conductive filler is uniformly distributed over the polymer. This polymer is normally a polyolefin (e.g., the polyethylene) and this conductive filler is normally the carbon black, metallic grains or inoxidized ceramic powder, for instance, the titanium carbide or tungsten carbide.

The polyolefin may be modified to obtain a used Poly Vinylidene Fluoride (PVDF), whose chemical structure of monomer includes a carbon chain, two hydrogen atoms, which link to the carbon of this carbon chain, and fluorine atoms linking to this carbon. This monomer is polymerized to form the PVDF. Usually, the fluorine possesses water resists and endures temperature variation; therefore, the PVDF has the characteristic of environmental attack proof.

There are many means for manufacturing the PVDF, and their properties are also different with respect to different means. However, their usual melting points are around the range of 160° C. to 180° C.

In order to enhance the performance of the PVDF in advance, it is possible to blend the PVDF with another polymer. For example, the Tetrafluoroethylene (TFE), which is a fluorine-based polymer called full fluorination, is used to reduce the electrical resistance of the PVDF blend after trip recovery.

In practical application, the over-current protection device usually faces more severe environmental conditions. For example, for those electromechanical devices located beneath the engine hood of a car, their design must consider that the engine is constantly running and also the climate outside the car to make the device expose under humidity and high temperature for a long time. Consequently, the over-current protection device has to increase the capability of humid proof and temperature varied endurance in advance.

SUMMARY OF THE INVENTION

The objective of the present invention is to provide a conductive polymer composition and its constitutional over-current protection device to reduce the difference of electrical resistance between pre and post trip, and increase the capability of humid proof and temperature-varied endurance.

In order to increase practical availability and developing space, the present invention discloses a conductive PPTC polymer composition, which includes the polymer substrate, conductive filler and the polyolefin. This conductive filler may be carbon black and this polymer substrate may be PVDF. The following interpretation takes PVDF as an example. This polyolefin is blended into the PVDF, its chemical formula is:

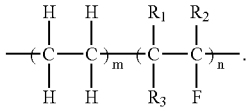

The carbon atoms in the left side bond four hydrogen atoms and the two carbon atoms in the right side bond a fluorine atom. R1, R2 and R3 atoms are individual monomers. The "m" is an integer greater than or equal to zero and "n" is a positive integer greater than or equal to one. R1, R2 and R3 may be fluorine, chlorine, bromine, iodine or hydrogen atoms. However, there is at least one halogen atom of non-fluorine element selected from chlorine, bromine and iodine among the group including R1, R2 and R3.

Compared to the prior art technology, the present invention replaces full fluorination polymer blended in the PVDF by chlorine, bromine and iodine polymers, and obtains different physical properties by the aid of different arrangement in polymer cross linkage, for instance, isotactic or tactic.

This PVDF blended with a polyolefin constructs a copolymer. If "m" and "n" are equal to one, it is an alternative arrangement. If "m" and "n" are positive integers greater than 1, it is a block combination. Blending a conductive carbon black into this copolymer will form the present invention of conductive polymer composition. It possesses the property of positive temperature coefficient to be used as the basic material of polymer current-sensing layer in the over-current protection device.

Each chemical radical in the polyolefin is a single covalence bonding with the carbon atom in the carbon chain. The positive integers "m" and "n" in the block combination are properly selected to be the called random copolymer, which has two types of polymerization, alternating and random, in order to possibly increase the degree of freedom in design.

Arranging the polyolefin in three-dimensional tacticity by isotactic or atactic will increase another degree of freedom, thus on demand of meeting practical products' specifications can modify the arrangement of the copolymer to accord with their physical performance.

DETAILED DESCRIPTION OF THE INVENTION

The conductive polymer composition of the present invention includes a polyolefin whose chemical structure is shown as formula (1).

(1)

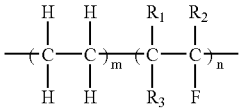

In general, the melting point (Tm2) of this polyolefin is selected to be higher than the melting point (Tm1) of the PVDF around the range of 15° C. to 100° C., that is, Tm1+15° C.<Tm2<Tm1+100° C. This manipulation will increase the melting point of the random copolymer blend in order to enhance the humid proof and temperature endurance, and furthermore, to extend the usage scope of these related products.

The first embodiment of the polyolefin of the present invention has chemical structure as formula (2).

(2)

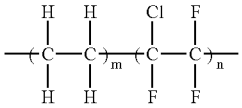

In formula (2), the Cl (chlorine) corresponds to R1 in formula (1), and R2, R3 in formula (1) also correspond to the F (fluorine). In other words, the second monomer constructs a called Poly-Ethylene Chlorotrifluoro-Ethylene (PECTFE) according to the Cl by F ratio of 1:3. In the present embodiment, the volume ratio of the polyolefin and the PVDF is in the range of 1% to 40%, and is lower than 20% is the better. Moreover, in formula (2) the "m" can also be zero, i.e., the polyolefin is composed of PECTFE.

The second embodiment of the polyolefin of the present invention is the case of both "m" and "n" in formula (1) being equal to 1, that is, these two monomers arrange in alternating. Following this rule will simplify the manufacturing and achieve the benefit of cost reduction.

The third embodiment of the polyolefin of the present invention is to intersect the conditions of the above embodiments, that is, the Cl by F ratio in the second monomer is 1:3, and both the integers of "m" and "n" equal to 1. Besides, it is preferred to choose the PVDF as a substrate with the melting point 170° C. However, the melting point might be selected to be in the range of 160° C. to 180° C. in practice. The melting point of the resulting polyolefin is about 230° C., and its possible melting point varies in the range of 220° C. to 240° C. The blending volume ratio of this PVDF and the polyolefin is about 9:1. To mix the carbon black into the PVDF and the polyolefin will obtain the conductive polymer composition of the present invention. The present embodiment has the mixing volume ratio as follows:

$$\text{Carbon black}: PVDF : PECTFE = 40\% : 54\% : 6\%$$

The above description from the first embodiment to the third embodiment covers the implementation points of the present invention. Also, the over-current device with positive temperature coefficient property fabricated by the present invention will increase melting point to suit high temperature and high humid environment.

Figure 1:
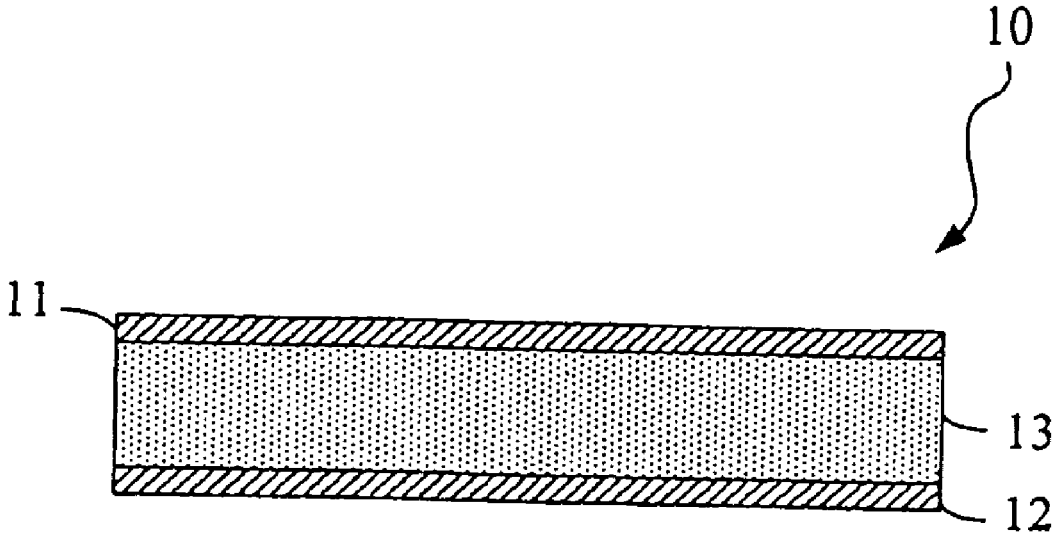
FIG. 1 is a diagram of the over-current protection device of the present invention.

FIG. 1 illustrates a diagram of the preferred embodiment of the present invention. The over-current device 10 includes one first electrode 11, one second electrode 12 and one polymer current-sensing layer 13. This polymer current-sensing layer 13 squeezed between the first electrode 11 and second electrode 12 has the principal material of the conductive polymer composition of the present invention.

In trip endurance test, the device-under-test (DUT) undergoes different periods after it turns up to high electrical resistance, and then counts the lasting hours in the state of high electrical resistance. The consequent step is to cut the power supply that is imposed upon this DUT and recovers this DUT back to normal temperature and then measures its electrical resistance again. Following this way to investigate the recovered value of electrical resistance is used to judge the resist capability of the DUT to aging degradation by high temperature stress.

The procedure to test the trip endurance of the DUT is to impose a DC power of 19 volt/40 Ampere on the DUT. This DUT stressed by this condition for a period will transform part of electrical energy into heat and then continuously raise the temperature of this DUT until a critical point to jump its electrical resistance up to a high value. At this moment of high electrical resistance state, the circuitry current will drop to below 0.1 ampere of low value, and make most of voltage drop across this DUT.

Figure 2:
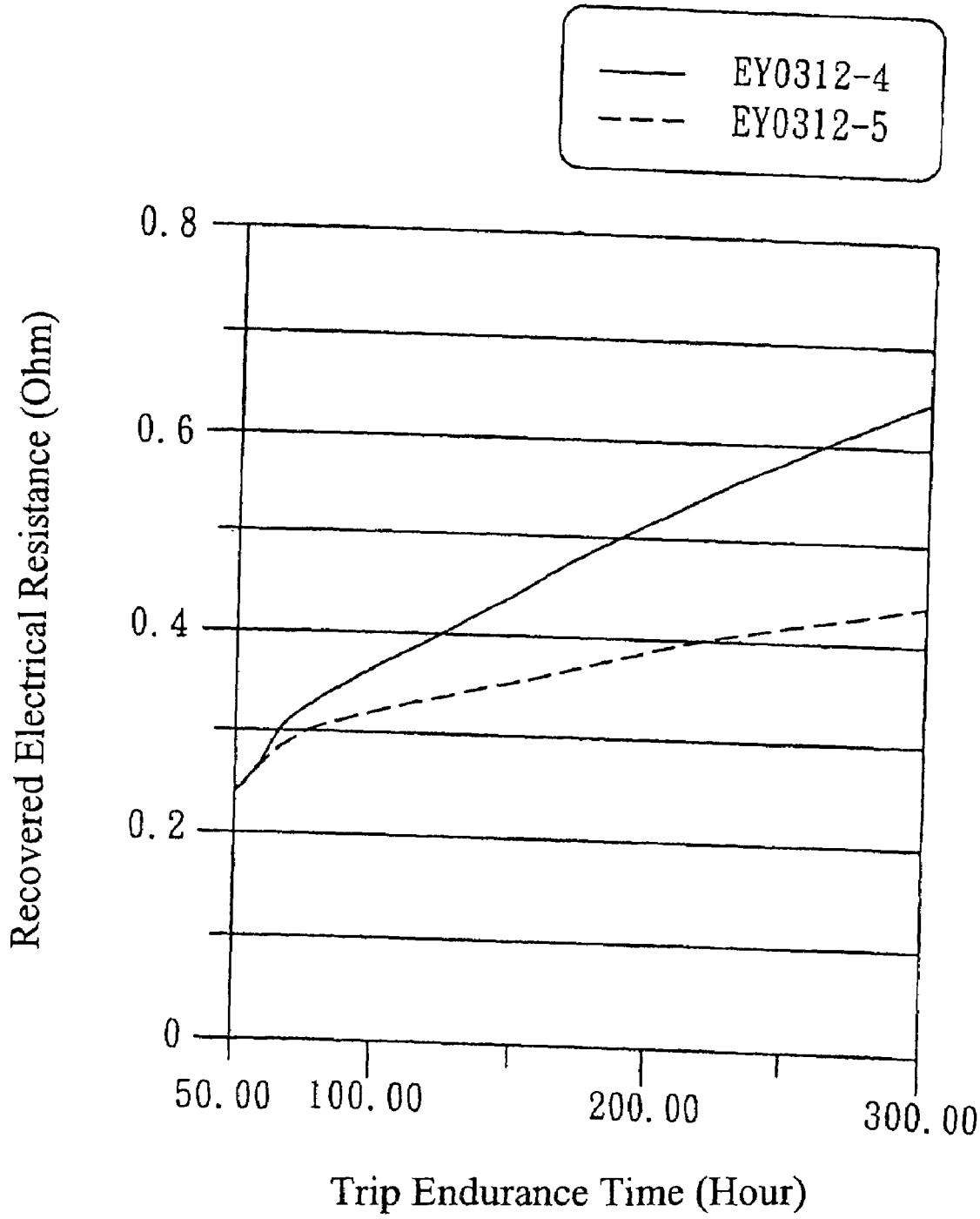
FIG. 2 illustrates an experimental relationship of trip endurance time versus recovered electrical resistance of the over-current protection device of the present invention.

FIG. 2 shows the recovered electrical resistance of the DUT. Sample EY0312-4 represents the DUT without adding any conductive polymer of the present invention; and its counterpart is sample EY0312-5, which represents the DUT with adding the polyolefin of the third embodiment of the present invention. Comparison between the two DUTs will clearly show that the DUT with adding the polyolefin of the third embodiment of the present invention largely reduces the electrical resistance relative to the one without adding any conductive polymer of the present invention.

Figure 3:
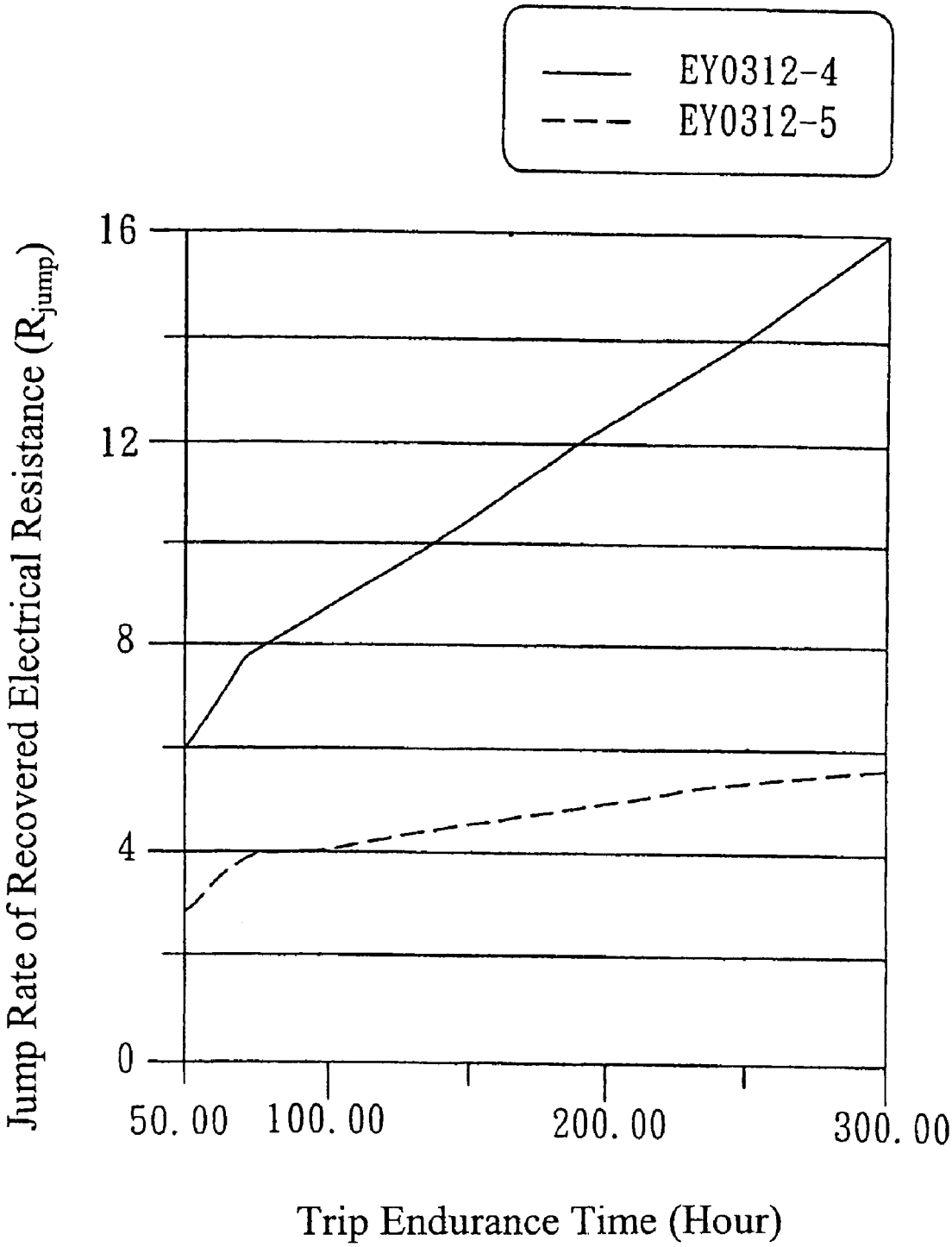
FIG. 3 illustrates an experimental relationship of trip endurance time versus the jump rate of recovered electrical resistance of the over-current protection device of the present invention.

FIG. 3 shows the jump ratio ($R_{jump}$) of recovered electrical resistance of experimental sample EY0312-4 and EY0312-5. This $R_{jump}$ is defined as follows:

$$R_{jump} = R_i \div R_0$$

Wherein $R_0$ is the initial electrical resistance; $R_i$ is the electrical resistance measured again after the DUT experiences a high electrical resistance value and lasts a different period i of trip endurance, and then cuts its imposed power to recover this DUT back to normal temperature.

Referring to FIG. 3, the DUT with adding the polyolefin of the third embodiment of the present invention largely reduces the jump ratio of recovered electrical resistance relative to the one without adding any conductive polymer of the present invention.

Tracking both FIG. 2 and FIG. 3, the recovered electrical resistance of the sample with conductive polymer composition of the present invention approaches the initial electrical resistance, especially to mention is the more benefit along the imposed duration. These experiments present the result of obvious improvement on electrical stability of the over-current device that is fabricated by conductive polymer composition of the present invention.

In practical application, the polymer substrate used in the conductive polymer composition of the present invention is not limited to the PVDF. Other ones that possess positive temperature coefficient property are available for applications.

The above-described embodiments of the present invention are intended to be illustratively only. Numerous alternative embodiments may be devised by those skilled in the art without departing from the scope of the following claims.

What is claimed is:

1. A conductive polymer composition exhibiting positive temperature coefficient property, comprising:

a polymer substrate;

a conductive filler; and a polyolefin having chemical structure of:

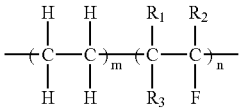

wherein R1, R2 and R3 are selected from the group consisting of hydrogen, chlorine, bromine and iodine, wherein at least one element of the group R1, R2 and R3 is a halogen atom selected from the group consisting of chlorine, bromine and iodine, and at least one element of the group R1, R2 and R3 is a hydrogen atom, "m" is an integer greater than or equal to zero and "n" is a positive integer, symbol "C" represents carbon and symbol "H" represents hydrogen.

2. The conductive polymer composition in accordance with claim 1, wherein both "m" and "n" equal to one.

3. The conductive polymer composition in accordance with claim 1, wherein the melting point of the polyolefin is in a range of 220° C. to 240° C.

4. The conductive polymer composition in accordance with claim 1, wherein the conductive filler is carbon black.

5. The conductive polymer composition in accordance with claim 1, wherein the material of the polymer substrate is Poly Vinylidene Fluoride (PVDF).

6. The conductive polymer composition in accordance with claim 5, wherein the melting points of this PVDF (Tm1) and the polyolefin (Tm2) have the relationship of: Tm1+15° C.<Tm1+100° C.

7. The conductive polymer composition in accordance with claim 5, wherein the blending volume ratio of this PVDF and the polyolefin is in a range of 1% to 40%.

8. An over-current protection device, comprising:

a first electrode; and a second electrode; and a polymer current-sensing layer laminated between the first electrode and second electrode, and the polymer current-sensing layer comprising the conductive polymer composition of claim 1.

9. The over-current protection device in accordance with claim 8, wherein the melting point of the polyolefin is in a range of 220° C. to 240° C.

10. The over-current protection device in accordance with claim 8, wherein the material of the polymer substrate is PVDF.

11. The over-current protection device in accordance with claim 10, wherein the blending volume ratio of this PVDF and the polyolefin is in a range of 1% to 40%.

* * * * *

UNITED STATES PATENT AND TRADEMARK OFFICE

CERTIFICATE OF CORRECTION

PATENT NO. : 7,229,575 B2
APPLICATION NO. : 10/845400
DATED : June 12, 2007
INVENTOR(S) : David Shau-Chew Wang et al.

It is certified that error appears in the above-identified patent and that said Letters Patent is hereby corrected as shown below:

Column 5

Claim 2; line 32 after "n" should be --are--

Column 6

Claim 6, line 10 should read as follows: --Tm1 + 15°C < Tm2 < Tm1 + 100°C--

Signed and Sealed this

Twenty-eighth Day of August, 2007

JON W. DUDAS
*Director of the United States Patent and Trademark Office*